US007037021B2

(12) United States Patent
Raschke

(10) Patent No.: US 7,037,021 B2
(45) Date of Patent: May 2, 2006

(54) DUAL FLAP SCRAPBOOK INSERT LEAF

(75) Inventor: Jeffrey A. Raschke, Brookfield, IL (US)

(73) Assignee: C-Line Products, Inc., Mt. Prospect, IL (US)

( * ) Notice: Subject to any disclaimer, the term of this patent is extended or adjusted under 35 U.S.C. 154(b) by 156 days.

(21) Appl. No.: 10/732,058

(22) Filed: Dec. 9, 2003

(65) Prior Publication Data

US 2005/0036826 A1 Feb. 17, 2005

Related U.S. Application Data

(60) Provisional application No. 60/494,679, filed on Aug. 13, 2003.

(51) Int. Cl.
*B42F 13/00* (2006.01)

(52) U.S. Cl. ..... 402/79; 281/38; 402/80 R; D19/33

(58) Field of Classification Search ..... 402/79, 402/80 R, 80 P; 281/22, 38; D19/26, 27, D19/33

See application file for complete search history.

(56) References Cited

U.S. PATENT DOCUMENTS

| | | | | | |
|---|---|---|---|---|---|
| 3,735,516 | A | * | 5/1973 | Wenstrom | 40/536 |
| 4,824,273 | A | * | 4/1989 | Silva et al. | 402/79 |
| 5,371,560 | A | * | 12/1994 | Kiehne et al. | 353/120 |
| 5,431,449 | A | * | 7/1995 | Arimoto et al. | 281/31 |
| 5,722,694 | A | * | 3/1998 | Baldursson | 283/116 |
| 5,795,089 | A | * | 8/1998 | Ong | 402/79 |
| 6,164,859 | A | * | 12/2000 | Hambright | 402/73 |

* cited by examiner

*Primary Examiner*—Monica S. Carter
(74) *Attorney, Agent, or Firm*—Barnes & Thornburg LLP; David C. Brezina; Mark J. Nahnsen

(57) ABSTRACT

A dual flap scrapbook insert leaf for mounting in a scrapbook for preserving scrapbook displays and storing the displays in a multi-ring photo or scrapbook album. The dual flap scrapbook insert leaf consists of four polypropylene sheets laminated together and folded to form a plurality of display pockets. One of the sheets is formed and arranged to allow for the lamination of the other sheets thereupon. The scrapbook insert leaf further includes a plurality of apertures adapted to allow for connection to the multi-ring, post or strap hinge photo album.

25 Claims, 2 Drawing Sheets

DUAL FLAP SCRAPBOOK INSERT LEAF

This application claims the priority of U.S. Provisional application 60/494,679 filed Aug. 13, 2003 and having the same title and inventor.

BACKGROUND OF THE INVENTION

This invention relates to a book insert leaf and more specifically to a polypropylene scrapbook insert leaf that is adapted to retain and protect photographs and other cherished memories that are retained in a family album. Scrapbooking is the art of preserving cherished memories for years to come with a personalized scrapbook. Creating a scrapbook is become very popular for saving photographs and other cherished items. Plane tickets, attraction admission stubs, found objects, a pressed flower or even a child's drawing can become part of the keepsake scrap book. Typical scrapbook pages are approximately twelve inches square and are manufactured from paper. Scrapbook pages may also be manufactured in other sizes including 8.5"×11", 8"×8", 6"×6", among others. Photographs, pictures and other items are placed upon the page and arranged in an aesthetically pleasing manner. Once arranged, a plastic sheet is placed upon the photos to preserve positioning and retard aging. Since scrapbook displays are limited in size due to the physical dimensions of the scrapbook, a need has arisen for a scrapbook leaf that permits larger scrapbook displays to be created, without requiring the use of a larger book.

SUMMARY OF THE INVENTION

The dual flap scrapbook insert leaf for mounting in a scrapbook is designed to be a convenient and inexpensive method of preserving scrapbook displays and storing the displays in a multi-ring, post, or strap-hinge photo or scrapbook album. The preferred embodiment of this product consists of four polypropylene sheets laminated together and folded to form a plurality of display pockets. The sheets are formed and arranged to allow for the lamination of the other sheets thereupon. The scrapbook insert leaf further includes a plurality of apertures adapted to allow for connection to the album.

DETAILED DESCRIPTION OF THE PREFERRED EMBODIMENT

Figure 1:
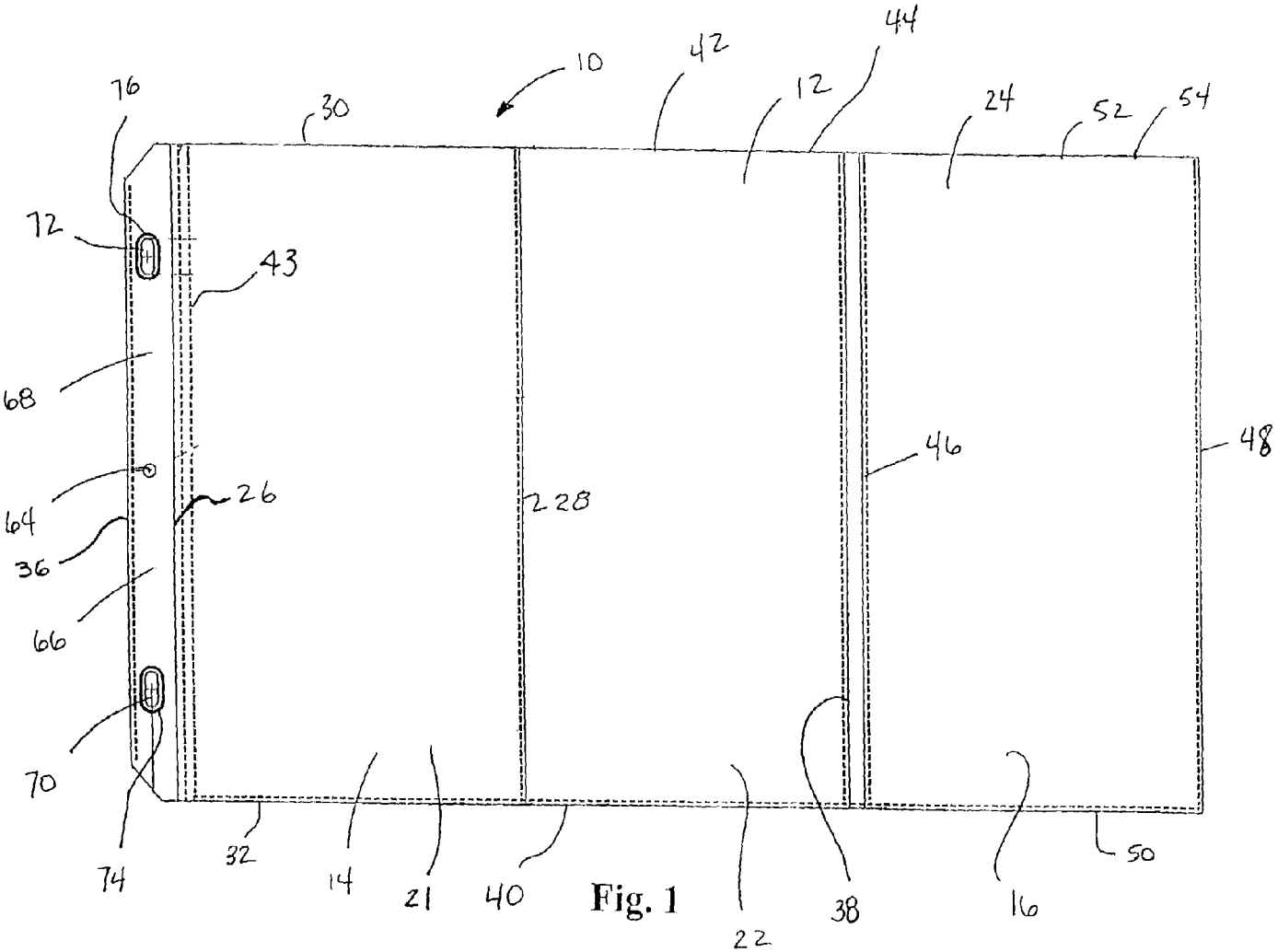
FIG. 1 is a top view of the dual flap scrapbook insert leaf with one flap in the open position and the other flap in a closed position.
Figure 2:
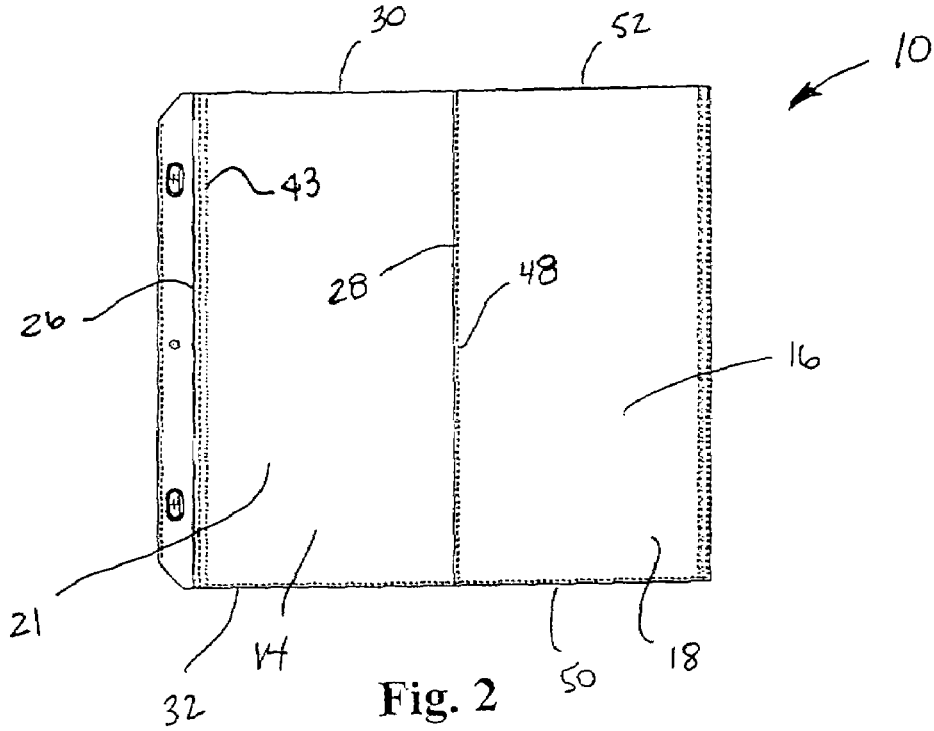
FIG. 2 is a top view of the dual flap scrapbook insert leaf with both flaps folded in a closed position.

For the purpose of promoting an understanding of the principles of the invention, references will be made to the embodiments illustrated in the drawings. It will, nevertheless, be understood that no limitation of the scope of the invention is thereby intended, such alterations and further modifications in the illustrated device, and such further applications of the principles of the invention illustrated herein being contemplated as would normally occur to one skilled in the art to which the invention relates.

A preferred embodiment of the dual flap scrapbook insert leaf 10 is shown in FIG. 1. The insert leaf 10 is adapted to be connected to a multi-ring album (not shown) and is adapted to retain photographs and other items that one would like to display. Also, in the preferred embodiment the insert leaf 10 is made of polypropylene sheet material. The benefits of polypropylene include, but are not limited to, better archivability of a display item. Additionally, a preferred embodiment of the insert leaf 10 uses a clear polypropylene. The clear polypropylene aids in the viewing of the display item.

Other material can be used provided it has the properties of being a foldable clear or matte material such that an object can be easily viewed from within the display device. The material is preferably capable of being thermally bonded. Additionally, the material may be smooth or textured, as certain adhesives may perform better on textured surfaces.

Figure 3:
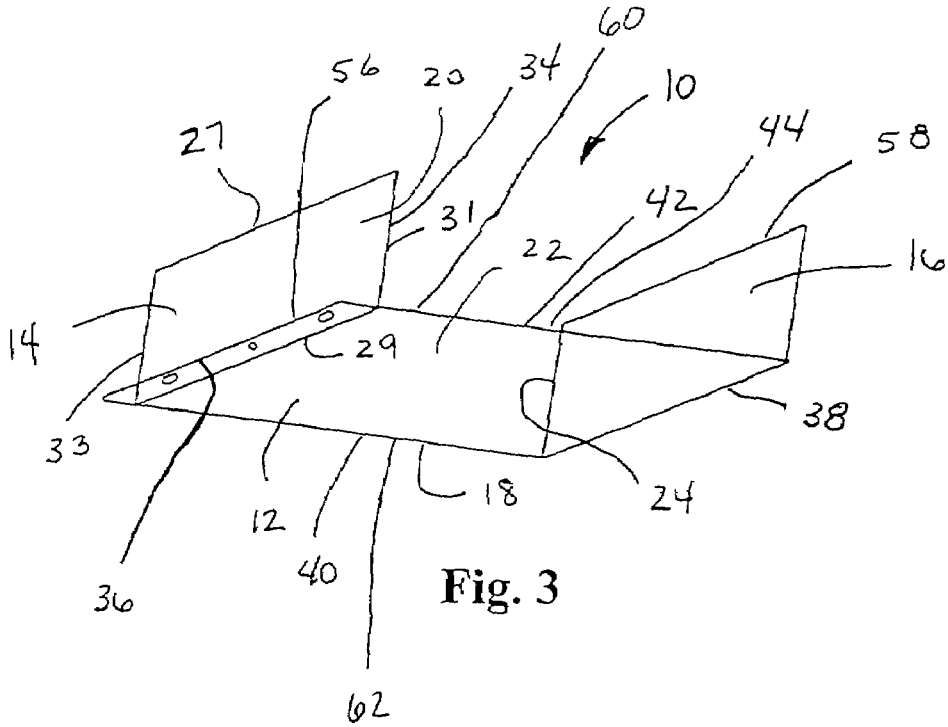
FIG. 3 is a perspective view of the dual flap scrapbook insert leaf with both flaps in an open position.

The insert leaf 10 is comprised of a central pocket 12, a left flap pocket 14 and a right flap pocket 16 as shown in FIG. 3. The description of the insert leaf using positional language is for illustrative purposes only and is written to correspond to the orientation of the drawings, which are in a landscape position, adapted to be attached to an album along the left edge of the insert leaf 10. Using an album with an attachment mechanism along the top edge would require the insert leaf to be reoriented in a portrait position. The insert leaf 10 includes a bottom sheet 18, a top left lower sheet 20, a top left upper sheet 21, a central sheet 22 and a right sheet 24. The right sheet 24 may be formed from a portion of the central sheet 22 with a section between the sheets. The sheets 18, 20, 21, 22 and 24 are preferably fabricated from polypropylene but other materials can be used that are known to those skilled in the art. The top left upper sheet 21 includes left and right edges 26, 28 and top and bottom edges 30, 32. The top left lower sheet 20 includes left and right edges 27, 29 and top and bottom edges 31, 33. The forming of and bonding of the top left lower sheet 20 to the top left upper sheet 21 is accomplished by attaching the top left upper sheet 21 to the top left lower sheet 20 about the right and bottom edges 28, 27, 32 and 33. The top left upper sheet 21 and top left lower sheet 20 are attached to the central sheet 22 in the reinforcement region 68 along the left edge 26 of the top left upper sheet 21 and the right edge 29 of the top left lower sheet 20 utilizing various means including heat sealing, ultrasonic welding, stitch welding, or gluing to create the left flap pocket 14. As described above, thermal heat sealing or welding is preferred. The top edges 30, 31 of the left flap pocket 14 are not bonded and provides for a slot 34 for the left flap pocket 14.

The central sheet 22 of the insert leaf 10 is formed and arranged to fit within a multi-ring, post, or strap-hinge photo or scrapbook album which is preferably 12"×12", 8.5"×11", 6"×6", 8"×8". Other sizes may be used, depending upon the design and sizing of the photo or scrap booking albums. The central sheet 22 includes a left edge 36, a spaced apart right edge 38, a bottom edge 40 and a spaced apart top edge 42. The forming and bonding of the central sheet 22 to the bottom sheet 18 is accomplished by attaching the central sheet 22 about the left, right and bottom edges, 36, 38 and 40 by thermal heat sealing or welding. A secondary weld , as shown in FIG. 1, forms the left edge 43 of the central pocket 12. The top edge 42 of the central sheet 22 is not bonded and provides for a central slot 44 for the central pocket 12 to allow for the ingress and egress of photographs and other articles. Alternatively, the forming and bonding of the central sheet 22 to the bottom sheet 18 could be accomplished by attaching the central sheet 22 about the top, left and bottom edges, 42, 36 and 40 by thermal heat sealing or welding. In this alternative, the right edge 38 of the central sheet 22 is not bonded and provides for a slot to allow for the ingress and egress of photographs and other articles. The left edge 36 of the central sheet 22 is spaced apart from the right edge 29 of the left lower sheet 20, when in an open position, to allow clearance for folding.

The right sheet 24 of the insert leaf 10 is approximately half the width of the central sheet 22 and is adapted to be folded over and positioned adjacent to the central sheet 22. The right sheet 24 includes a left edge 46, a spaced apart right edge 48, a bottom edge 50 and a spaced apart top edge 52. The forming and bonding of the right sheet 24 to the bottom sheet 18 is accomplished by attaching the right sheet 24 about the left, right and bottom edges, 46, 48 and 50 by thermal heat sealing or welding. The right sheet 24 may be formed from a portion of the central sheet 22 with a section between the sheets stripped out to form individual pockets. The top edge 52 of the right sheet 24 is not bonded and provides for a slot 54 for the right flap pocket 16 to allow for the ingress and egress of photographs and other articles. Alternatively the right flap pocket 16 could be formed by leaving the left edge 46 unbonded and bonding the top, right and bottom edges 52, 48 and 50 to form a pocket. The left edge 46 of the right sheet 24 is spaced apart from the right edge 38 of the central sheet 22 to allow clearance for folding.

The bottom sheet 18 of the insert leaf 10 includes a left edge 56, a spaced apart right edge 58, a top edge 60 and a spaced apart bottom edge 62 as shown in FIG. 3. The four edges of the bottom sheet 18 define the outer perimeter when the right flap pocket 16 is unfolded. When folded, the left edge 46 of the right sheet 24 and the right edge 38 of the central sheet 22 define the right perimeter edge of the insert leaf 10. The left edge 56 of the bottom sheet 18 is sealed to the left edge 36 of the central sheet 22. This arrangement creates a reinforced region 68 to reduce the likelihood of tear-out of the photo album and to allow pages to lay flat when turned in the album. The reinforced region 68 includes a circular aperture 64 positioned equidistant from the top edge 60 and the bottom edge 62 of the bottom sheet 18 and is adapted to accept a ring from the photo album. The reinforced region 68 also includes a pair of elongated apertures 70, 72 that are spaced apart from the circular aperture 64. The elongated apertures 70, 72 include reinforcing rings 74, 76 that strengthen elongated apertures 70, 72 to prevent pull-through.

In use, the insert leaf 10 is attached to a photo album by connecting the apertures 64, 70 and 72 to the binder rings, posts or straps. Once connected to the photo album, the left flap pocket 14 and right flap pocket 16 of the insert leaf 10 are hinged outward, exposing the central pocket 12. Once the user has created the photo scrapbook arrangements of choice, a first arrangement formed and arranged to fit within the slot 34 is inserted into the left flap pocket 14, a second arrangement formed and arranged to fit within the slot 44 is inserted into the central pocket 12 and a third arrangement formed and arranged to fit within the slot 54 is inserted into the right flap 16, creating an overall arrangement.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. An insert leaf for attachment to an album comprising:

a central pocket having an opening therein;

a left pocket having an opening therein and adapted to be folded over a portion of and contacting the central pocket thereby forming overlapping pockets with at least two sheets between the pockets;

a right pocket having an opening therein and adapted to be folded over a portion of and contacting the central pocket;

the pockets being formed of a polymer; and a reinforcement region formed along an edge of the insert leaf to prevent tear out from the album;

the left and central pockets both having a side positioned adjacent the reinforcement region.

2. The insert leaf of claim 1 further including a bottom sheet.

3. The insert leaf of claim 2 further including a central top sheet formed of a polymer bonded to a portion of the bottom sheet along three edges of the central top sheet to form the central pocket.

4. The insert leaf of claim 3 further including a left lower sheet formed of polymer, the lower left sheet bonded to a portion of the central top sheet along an edge of the left lower sheet.

5. The insert leaf of claim 4 further including a left upper sheet formed of a polymer, the left upper sheet bonded to a portion of the left lower sheet along three edges of the left upper sheet to form the left pocket.

6. The insert leaf of claim 5 further including a right sheet formed of a polymer, the right sheet bonded to a portion of the central top sheet along three edges of the right sheet to form the right pocket.

7. The insert leaf of claim 6, wherein the insert leaf includes fold lines to permit folding of the right pocket and the left pocket upon the central pocket.

8. The insert leaf of claim 1, wherein the reinforced area of the insert leaf includes a plurality of apertures adapted to be connected to the album.

9. The insert leaf of claim 1, wherein the insert leaf is made from polypropylene.

10. The insert leaf of claim 5 wherein the left pocket permits viewing of an article contained within from a first side and a second side.

11. The insert leaf of claim 6, wherein the right pocket permits viewing of an article contained within form a first side and a second side.

12. The insert leaf of claim 3, wherein the central pocket permits viewing of an article contained within from a first side and a second side.

13. An insert leaf for attachment to an album comprising:

a bottom sheet formed from a polymer;

a central top sheet formed of a polymer, the central top sheet bonded to a portion of the bottom sheet along three edges of the central top sheet to form a central pocket;

a left lower sheet formed of a polymer, the lower left sheet bonded to a portion of the central top sheet along an edge of the left lower sheet;

a left upper sheet formed of a polymer, the left upper sheet bonded to a portion of the left lower sheet along three edges of the left upper sheet to form a left pocket;

a right sheet formed of a polymer, the right sheet bonded to a portion of the bottom sheet along three edges of the right sheet to form a right pocket;

a reinforced region formed along an edge of the insert leaf to prevent tear out from the album; and when closed the right pocket and left pocket are each folded directly upon and contacting a portion of the central pocket.

14. The insert leaf of claim 13, wherein the insert leaf is made from polypropylene.

15. The insert leaf of claim 14, wherein the reinforced area of the insert leaf includes a plurality of apertures adapted to be connected to a multi-ring post of the album.

16. The insert leaf of claim 13, further including a fold line created between the central top sheet and the right sheet to permit the right sheet to be folded upon the central pocket.

17. A five panel, three pocket foldable insert leaf for holding objects within the insert leaf comprising:

a first panel;

a second panel bonded to a portion of the first panel about three sides of the second panel to form a first pocket;

a third panel bonded about three sides to a fourth panel to form a second pocket, the second pocket bonded along one side to the first pocket;

a fifth panel bonded to a portion of the first panel about three sides of the fifth panel to form a third pocket, the third pocket joined to the first pocket along a side of the first pocket different from said one side;

when closed the second pocket and third pocket are each folded directly upon and contacting a portion of the first pocket.

18. The five panel, three pocket foldable insert leaf of claim 17 wherein the five panels are made from polypropylene.

19. The five panel, three pocket foldable insert leaf of claim 17, further including a reinforced area formed along an edge of the insert leaf to prevent tear out from the album.

20. The five panel, three pocket foldable insert leaf of claim 19, wherein the reinforced area of the insert leaf includes a plurality of apertures adapted to be connected to a multi-ring post of the album.

21. The five panel, three pocket foldable insert leaf of claim 17, further including a fold line created in between the second panel and the fifth panel to permit the third pocket to be folded upon the first pocket.

22. A three pocket tri-fold insert leaf for attachment to an album comprising:

a first panel comprising overlapping first and second sheets forming a first pocket, a second panel comprising overlapping third and fourth sheets forming a second panel joined to the first panel along a first side edge of the first panel, a third panel comprising overlapping sheets forming a third pocket panel joined to the first panel along a side edge of the first panel different from the first side edge of the first panel.

23. The three pocket foldable insert leaf of claim 22 including a first fold line between the first pocket and the second pocket wherein the second pocket is folded upon a portion of the first pocket, and a second fold line created between the first pocket and a third pocket wherein the third pocket is folded upon a portion of the first pocket.

24. The three pocket foldable insert leaf of claim 22 wherein the first pocket is formed by bonding at least two sides of the overlapping sheets, and the second pocket is formed by bonding at least two sides of the overlapping sheets.

25. The three pocket foldable insert leaf of claim 24 wherein the third pocket is formed by bonding at least two sides of the overlapping sheets.

* * * * *